US007475667B2

(12) United States Patent
Al-Bannai

(10) Patent No.: US 7,475,667 B2
(45) Date of Patent: Jan. 13, 2009

(54) POWER TRAIN FOR MOTOR VEHICLES OR THE LIKE

(76) Inventor: Mohammad Esmael Al-Bannai, Block 9, Street 1, House 111, Aljabriya (KW)

( * ) Notice: Subject to any disclaimer, the term of this patent is extended or adjusted under 35 U.S.C. 154(b) by 0 days.

(21) Appl. No.: 11/672,277

(22) Filed: Feb. 7, 2007

(65) Prior Publication Data

US 2008/0188340 A1 Aug. 7, 2008

(51) Int. Cl.
*F02B 75/32* (2006.01)

(52) U.S. Cl. ..... 123/197.1; 123/197.4

(58) Field of Classification Search ..... 123/197.1, 123/197.4

See application file for complete search history.

(56) References Cited

U.S. PATENT DOCUMENTS 3,693,464 A * 9/1972 Wieckmann ..... 123/197.4

4,836,149 A * 6/1989 Newbold ..... 123/44 R

* cited by examiner

*Primary Examiner*—Noah Kamen

(74) *Attorney, Agent, or Firm*—Lowe Hauptman Ham & Berner, LLP

(57) ABSTRACT

A four cycle internal combustion engine that eliminates the need for a crankshaft and fly wheel includes at least a cylinder and a piston reciprocally disposed in the cylinder. A spur gear and a connecting rod having a first end pivotally connected to the piston and a second end pivotally connected to the spur gear is provided. An outer ring gear engaging the spur gear, a sun gear and a plurality of planetary gears engaging the ring gear and the sun gear are provided for reciprocating the piston and a gear set so that the rotation of the spur gear translates into rotation of the sun gear. An output shaft is fixed to and rotated by the sun gear.

11 Claims, 4 Drawing Sheets

POWER TRAIN FOR MOTOR VEHICLES OR THE LIKE

FIELD OF THE INVENTION

This invention relates to a power train for motor vehicles and more particularly to a internal combustion engine and gear set that eliminates the use of a crank shaft and fly wheel.

BACKGROUND FOR THE INVENTION

Most motor vehicles including automobiles, boats, motorcycles etc. are powered by reciprocating piston engines. Such engines are routinely subjected to various load conditions such as acceleration, idling, varying loads etc. In the past and into the present time there has been an increased emphasis on economy, increasing mileage per gallon and on reducing the weight of motor vehicles.

A U.S. patent of Gamache, U.S. Pat. No. 5,170,757 discloses a variable horse power output gearing for a piston engine. As disclosed, a piston engine has at least one cylinder and one piston, a crankshaft and gearing apparatus that has a set of two or more traveling gears fixed together which are rotating on a crank that belongs to: 1) either the crankshaft itself, 2) either an extended part of the crankshaft, or 3) to an auxiliary shaft which is geared to the crankshaft. One of the traveling gears is of irregular design and travels in a periodical way against a non-rotating internally toothed ring. The second traveling gear is of regular form and meshes with a rotating output ring, which in turn drives an output shaft which can be used as an output instead of the regular crankshaft and provides an alternate non regular pattern of piston displacement relative to output shaft rotation. The gearing apparatus provides a volume expansion rate in the cylinder which is conductive to efficient combustion.

Notwithstanding the above, there has been a continuing effort by engineers and scientists to develop new technology and improve on existing technology to produce significant improvements in the field of transportation and more particularly in internal combustion engines and transmissions. Therefore, it is presently believed that there is a need and a potential commercial market for an improved power transmission for motor vehicles or the like in accordance with the present invention.

It is presently believed that the power trains, engine and transmissions in accordance with the present invention will reduce the weight of the power train by eliminating the crankshaft and fly wheel from the power train. Further, it is believed that the engines and power trains will be more efficient than conventional power trains, will be durable, reduce space requirements by combining the engine and transmission and reduce manufacturing costs for motor vehicles.

In essence, it is believed that the efficiency of the present invention engines is higher than existing engines. The size and weight of the engine gear box assembly will be relatively small as the gear box, including a fly wheel and a crankshaft, have been eliminated. It is also believed that lubrication of the engine and gear box separately will be replaced by a single sump. Further the cooling system of the engines cylinders is also extended to the gear box in order to reduce the temperature so that the life of the gear trains will be high. Further, the use of roller bearings between the connecting rod and pinion gear will reduce friction and heat so that the torque loss is low. In addition, the design of the present engine may incorporate removeable types of cylinders so that it will be easy to change cylinders in the event of wear and that such replacement can be done at a relatively small cost particularly with respect to the cost for replacing an engine. Still further, while applying brake, the main drive will be disengaged from the gear box so that the stored energy will not be transferred. Also, the present engine should reduce the possibility of leakage of oil, decrease engine vibration and noise and it will be of compact size.

Further advantages to the power train engine and gear train in accordance with the present invention reside in higher efficiency, size and weight of the engine gear box assembly, elimination of the crankshaft and fly wheel and an opportunity to extend the engine cooling system to the gear box in order to reduce the temperature of the gear box. It is also contemplated to use roller bearings between the connecting rod and piston to reduce further heat and torque loss. In addition, it is contemplated that the design of the power train in accordance with the present invention reduces the likelihood of oil leakage and the need of oil seals and will decrease vibration and noise.

BRIEF SUMMARY OF THE INVENTION

In essence, the present invention contemplates a reciprocating internal combustion engine that eliminates the need for a crankshaft and a fly wheel. The engine comprises an engine block and a hollow cylinder defined by the engine block or separable there from and a piston disposed in the cylinder for reciprocal movement therein. A rotary gear train includes an output shaft and a connecting rod for connecting the piston to the gear train and for converting linear motion of the piston into rotational movement of an output shaft.

In a preferred embodiment of the invention a four cycle internal combustion engine includes a cylinder and piston reciprocally disposed in the cylinder. A connecting rod, having a first end pivotally connected to the piston and a second end pivotally connected to a spur gear, is provided to translate linear movement of the piston to rotational movement of the spur gear. Means are provided for reciprocating the piston and a gear set including an outer ring gear engaging the spur gear. A sun gear and a plurality of planetary gears engage the ring gear and the sun gear so that rotation of the spur gear translates into rotation of the sun gear and wherein the output shaft is fixed to and rotated by the sun gear.

The invention will now be described in connection with the accompanying drawings herein like reference numerals have been used for like parts.

DESCRIPTION OF THE PREFERRED EMBODIMENTS OF THE INVENTION

Figure 1:
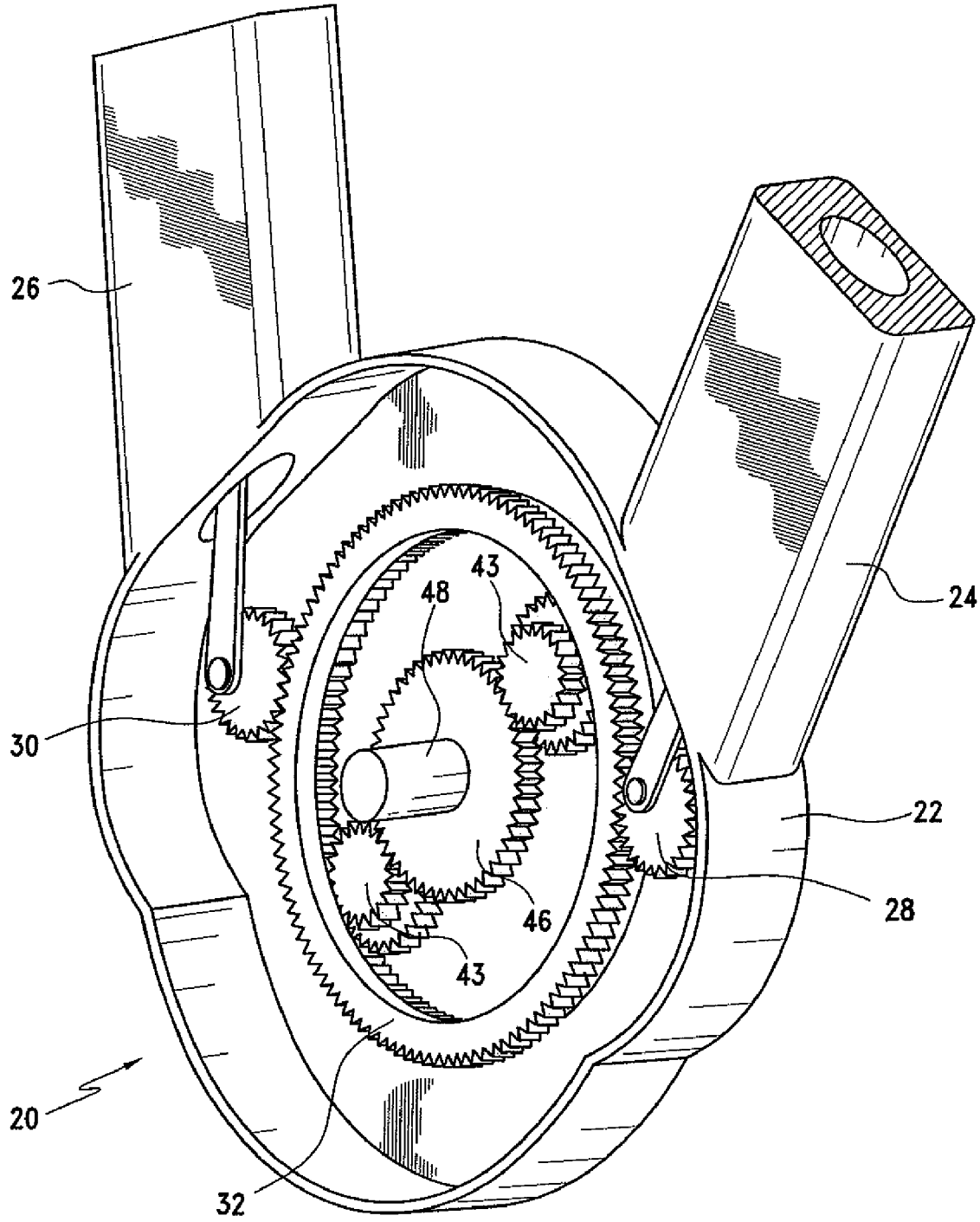
FIG. 1 is a perspective view of a portion of a power train in accordance with a preferred embodiment of the invention.
Figure 2:
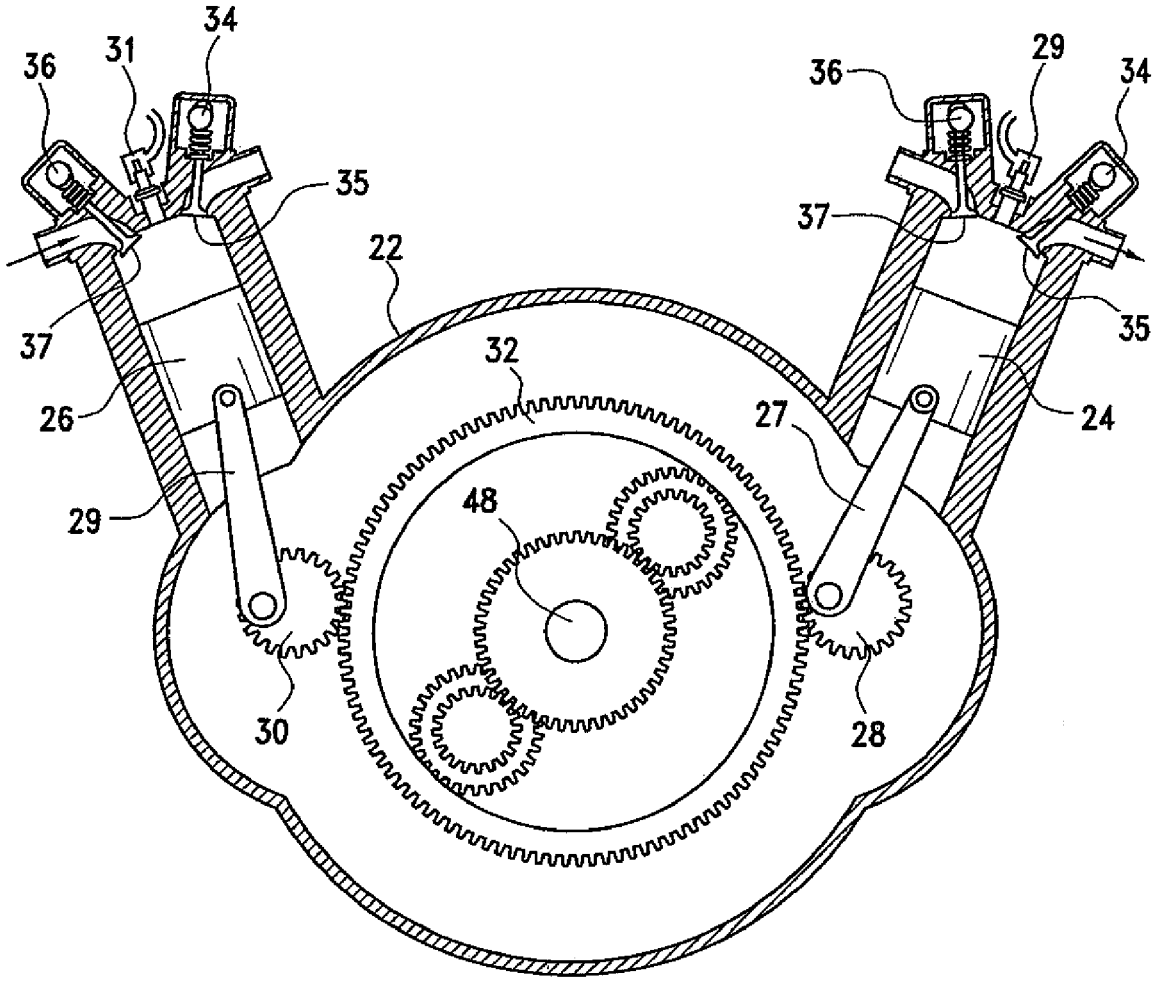
FIG. 2 is a schematic illustration of a planetary gear system as used in one embodiment of the present invention.

As illustrated in FIGS. 1 and 2, a four cycle internal combustion engine 20 includes a housing 22 and a pair of cylinders 24 and 26 which are fixed to the housing 22. The cylinders 24 and 26 may be permanently fixed to the housing as in a casting or removeably attached to the housing 22 in a conventional manner such as commonly used in many air cooled motorcycle engines.

As shown more clearly in FIG. 2, reciprocal pistons 23 and 25 are disposed in the cylinders 24 and 26 respectively and include conventional piston rings (not shown). Spur gears 28 and 30 are rotatably mounted in the housing 22 for engaging an outer rotary cylinder gear 32. A pair of connecting rods 27 and 29 are operatively connected at one end to pistons 23 and 25 respectively in a conventional manner and an opposite end to the spur gears 28 and 30.

An upper portion of the engine cylinder includes cylinders heads 35 and 37 at the top of the cylinders 24 and 26 with inlet and outlet valves 34 and 36. In addition, spark plugs 29 and 31 ignite fuel in the engine 20. The operation of the upper portion of the engine 20 is conventional for four cycle piston engines and may include cylinder heads, overhead earns and spark plugs. A timing chain (not shown) for opening and closing the valves and igniting the spark plugs is provided. A drive train using a shaft driven by a sun gear may be used to open and close the valves. It is also contemplated that the timing may be done electronically.

Figure 4:
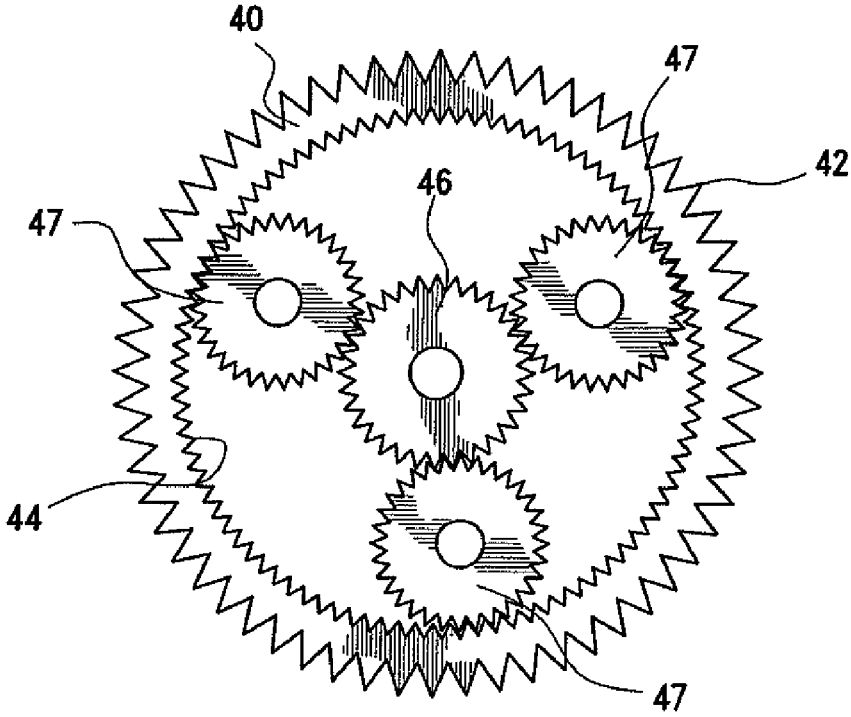
FIG. 4 is a schematic illustration of a planetary gear system in accordance with a third embodiment of the invention.

A key feature in the present invention resides in the use of a planetary gear system in place of a conventional crank shaft and fly wheel. The planetary gear system as shown more clearly in FIGS. 4 and 5 includes a ring gear 40 identified as an outer rotary ring gear 32 in FIGS. 1 and 2. The ring gear 40 includes a series of teeth 42 on an outer surface thereof and a series of inner teeth 44 around an inner surface thereof. The teeth 42 are operatively engaged by the spur gears 28 and 30 and rotatable by the spur gears 28 and 30 in response to the reciprocal movement of the pistons 24 and 26.

The inner teeth 44 engage a plurality of planetary gears 47 and are rotated by the ring gear 40 to thereby rotate the sun gear 46 which drives an output shaft. The planetary gears 47 are preferably reduction gears as shown in FIGS. 1 and 2.

Figure 5:
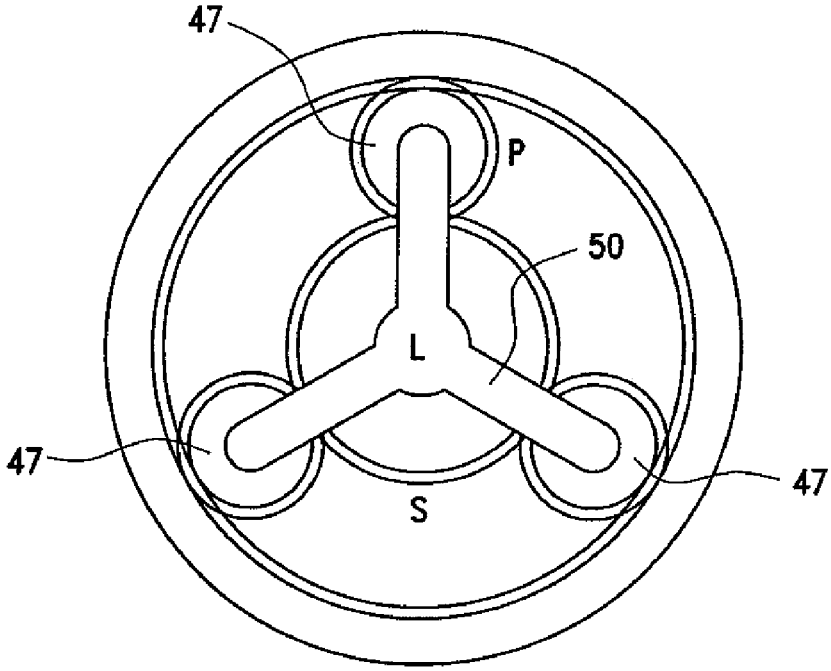
FIG. 5 is a cross-sectional view of a portion of the power train according to one embodiment of the invention.

As shown in FIG. 5 an epicycle gear train or planetary gear arrangement consists of one or more planetary gears 47 meshed with and rotating a central sun gear. The planetary gears are also meshed with and rotated within an internal ring gear and are fixed with planetary carrier-crank arm 50 designed to rotate on the same center as the sun gear 46. The planet carrier-crank arm 50 is used in a single epicycle gear train. This arrangement has a number of modes of operation depending on which members are locked.

Figure 3A:
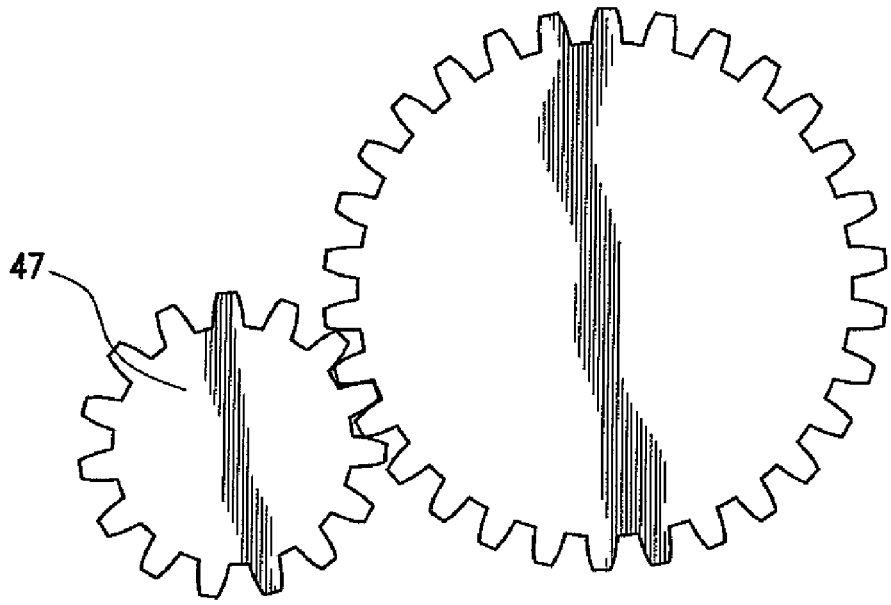
FIGS. 3*a* and 3*b* are schematic illustrations of a planetary gear system as used in a second embodiment of the invention.
Figure 3B:
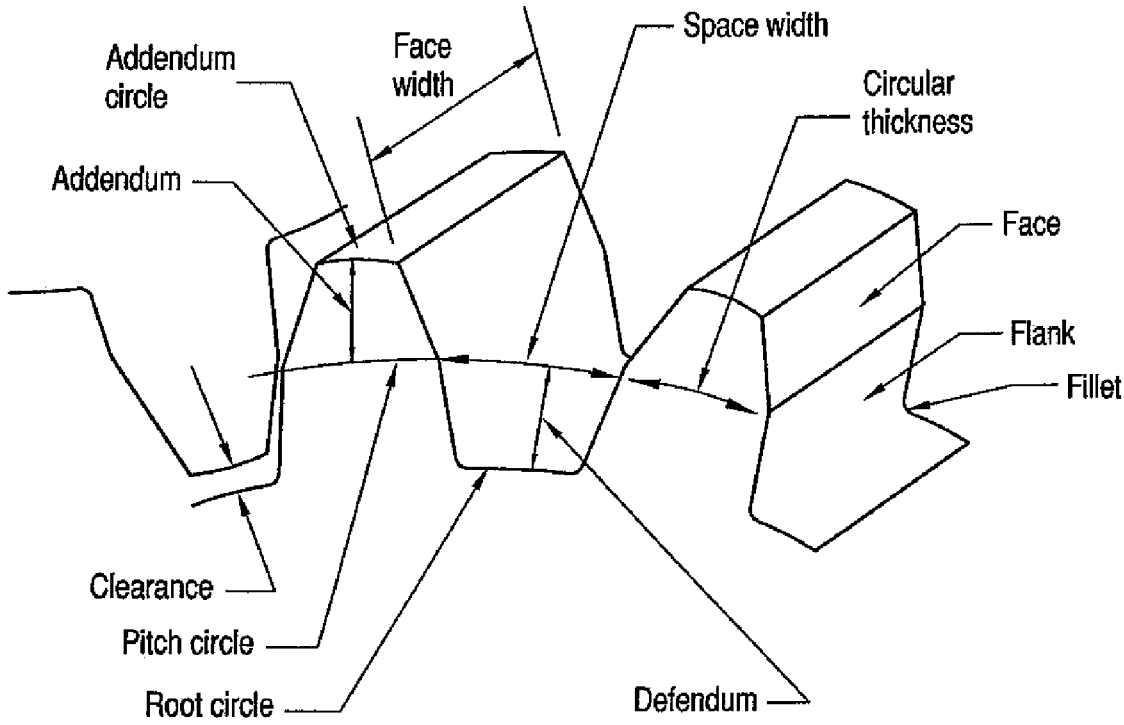

As shown in FIGS. 3*a* and 3*b* the spur gears 47 and gear 32 preferably have involute teeth i.e. the gear teeth curve inwardly and are rotated at a velocity ratio wherein the velocity ratio is the rotary velocity of a driver gear to that of a driven gear. Some of the main features of the gear teeth according to the present invention are illustrated in FIG. 3*b*. The teeth extend from the root, or dedendum cylinder (or colloquially, "circle") to the tip, or addendum circle. The useful portion of the tooth is the flank (or face), it is this surface which contacts the mating gear. The fillet in the root region is kinematically irrelevant since there is no contact there, but it is important insofar as fatigue is concerned.

The power train according to the present invention can generally be used in all reciprocating engines such as Internal combustion engines, External combustion engines, and thus attenuating the need for the crank shaft and the fly wheel.

While the invention has been described in connection with its preferred embodiment, it should be recognized that changes and modifications may be made therein without departing from the scope of the claims.

What is claimed is:

1. A four cycle internal combustion engine that eliminates the need for a crankshaft and fly wheel, said engine comprising a cylinder and a piston reciprocally disposed in said cylinder, a spur gear and a connecting rod having a first end pivotally connected to said piston and a second end pivotally connected to said spur gear, means for reciprocating said piston and a gear set including an outer ring gear engaging said spur gear, a sun gear and a plurality of planetary gears engaging said ring gear and said sun gear so that rotation of said spur gear translates into rotation of said sun gear and wherein an output shaft is fixed to and rotated by said sun gear.

2. A four cycle internal combustion engine in accordance with claim 1 in which said outer ring gear includes inner and outer teeth and wherein said spur gear engages the outer teeth of said ring gear and wherein said planetary gears engage said inner teeth of said outer ring gear.

3. A four cycle internal combustion engine according to claim 2 in which said sun gear and said output shaft rotate about a common axis and which includes three planetary gears and a planet carrier-crank arm that rotates about said common axis.

4. A four cycle internal combustion engine according to claim 3 in which said means for reciprocating said piston include means for injecting gas into said cylinder, means for igniting gas in said cylinder and means for ejecting spent gases from said cylinder.

5. A four cycle internal combustion engine according to claim 4 in which the spur gear and outer ring gear include involute teeth.

6. A four cycle internal combustion engine that eliminates the need for a crankshaft and fly wheel according to claim 5 which includes three planetary gears and a planet carrier-crank arm connecting said planetary gears for rotating about a common axis with said sun gear.

7. A power train comprising an internal combustion engine, an output shaft and a gear set for transmitting power from said internal combustion engine to said output shaft and said internal combustion engine including a cylinder and a piston reciprocally disposed in said cylinder, a spur gear and a connecting rod having a first end connected to said piston and a second end connected to said spur gear so that linear movement of said piston is converted to rotational movement of said spur gear; means for injecting gas into said cylinder and means for igniting gas and removing spent gas from said cylinder to thereby reciprocate said piston in said cylinder; and said gear set including an outer ring gear having internal and external teeth with said exterior teeth engaging said spur gear so that rotation of said spur gear rotates said ring gear, a sun gear having external teeth; and a plurality of planetary gears having external teeth engaging said internal teeth of said ring gear and the external teeth of said sun gear and wherein said output shaft is fixed to and rotated by said sun gear in response to the reciprocal movement of said piston.

8. A method for attenuating the need for a crankshaft and a fly wheel in a reciprocating engine, said method comprising:

providing a cylinder and a piston reciprocally disposed in the cylinder, a spur gear and a connecting rod having a first end pivotally connected to the piston and a second end pivotally connected to the spur gear;

providing an epicyclic gear train including an outer ring engaging the spur gear, a sun gear having an output shaft fixed thereto, a plurality of planetary gears and a carrier-crank arm operatively connecting the planetary gears;

meshing the outer ring gear with the spur gear and the outer ring gear with the epicyclic gear train for translating linear movement of the piston to rotational movement of the epicyclic gear train; and, reciprocating the piston to thereby rotate the spur gear and the epicyclic gear train to thereby rotate the output shaft fixed to the sun gear.

9. A method according to claim 8, wherein said method further comprises smooth rotation of an outer ring of said epicyclic gear train.

10. A reciprocating engine that eliminates the need for a crankshaft and fly wheel, said engine comprising a cylinder and a piston reciprocally disposed in said cylinder, a spur gear and a connecting rod having a first end pivotally connected to said piston and a second end pivotally connected to said spur gear, means for reciprocating said piston and a gear set including an outer ring gear engaging said spur gear, a sun gear and a plurality of planetary gears engaging said ring gear and said sun gear so that rotation of said spur gear translates into rotation of said sun gear and wherein an output shaft is fixed to and rotated by said sun gear.

11. A reciprocating engine in accordance with claim 10 in which said outer ring gear includes inner and outer teeth and wherein said spur gear engages the outer teeth of said ring gear and wherein said planetary gears engage said inner teeth of said outer ring gear.

* * * * *